US008806842B1

(12) United States Patent
Penn et al.

(10) Patent No.: US 8,806,842 B1
(45) Date of Patent: Aug. 19, 2014

(54) DISPOSABLE MULTIPLE COMPARTMENT MIXING AND DISPENSING CONTAINER

(75) Inventors: Steven Eric Penn, Ridgefield, CT (US); Ronald Radwin, Pittstown, NJ (US); Michael Anthony Castaldo, Monroe Township, NJ (US)

(73) Assignee: The Packaging Consultants Group, Brewster, NY (US)

( * ) Notice: Subject to any disclaimer, the term of this patent is extended or adjusted under 35 U.S.C. 154(b) by 602 days.

(21) Appl. No.: 13/134,839

(22) Filed: Jun. 20, 2011

(51) Int. Cl.
*B65B 3/02* (2006.01)

(52) U.S. Cl.
USPC ..... 53/453; 53/455; 53/474; 222/145.1

(58) Field of Classification Search
USPC ..... 53/453, 455, 474; 206/219, 221; 222/145.1, 145.5, 94
See application file for complete search history.

(56) References Cited

U.S. PATENT DOCUMENTS

| | | | | | |
|---|---|---|---|---|---|
| 2,176,923 | A * | 10/1939 | Nitardy | 222/94 |
| 3,618,751 | A * | 11/1971 | Rich | 206/219 |
| 4,657,534 | A | 4/1987 | Beck et al. | |
| 4,786,534 | A * | 11/1988 | Aiken | 428/34.2 |
| 4,952,068 | A | 8/1990 | Flint | |
| 5,114,004 | A * | 5/1992 | Isono et al. | 206/222 |
| 5,263,609 | A | 11/1993 | Hoshino | |
| 5,954,230 | A * | 9/1999 | Blette et al. | 222/1 |
| 7,097,075 | B2 * | 8/2006 | Peuker et al. | 222/94 |
| 7,887,231 | B2 * | 2/2011 | Suchan et al. | 366/130 |
| 2004/0065679 | A1 * | 4/2004 | Peuker et al. | 222/107 |
| 2005/0128866 | A1 | 6/2005 | Su | |
| 2005/0150904 | A1 * | 7/2005 | Suchan et al. | 222/94 |
| 2006/0171970 | A1 * | 8/2006 | Karl | 424/400 |
| 2007/0119862 | A1 * | 5/2007 | Backes et al. | 222/94 |
| 2007/0253761 | A1 * | 11/2007 | May | 401/133 |
| 2008/0083348 | A1 * | 4/2008 | Kuo et al. | 106/35 |
| 2008/0123465 | A1 | 5/2008 | Heusser et al. | |
| 2010/0256556 | A1 * | 10/2010 | Cray et al. | 604/87 |
| 2013/0284620 | A1 * | 10/2013 | Walter et al. | 206/221 |

* cited by examiner

*Primary Examiner* — Hemant M Desai
(74) *Attorney, Agent, or Firm* — Harpman & Harpman

(57) ABSTRACT

A frangible blister packaging for mixing and dispensing fluid at point of use. A multi-compartment force activated container formed by sealing a lidding closure material over formed fluid filled independent containment cavities interconnected by a pressure release frangible sealing area there between. A mixing flow path is initiated by compression on the upstream flexible compartment, forcing content fluid to mix into the downstream compartment for dispensing therefrom. The frangible sealing area is formed independently of the container compartment sealing assuring a force fluid transfer stream projection for maximum fluid inter-mixing before dispensing by compression of upstream compartment.

8 Claims, 3 Drawing Sheets

DISPOSABLE MULTIPLE COMPARTMENT MIXING AND DISPENSING CONTAINER

BACKGROUND OF THE INVENTION

1. Technical Field

This invention relates to mixing devices for fluids storage, transport and dispensing therefrom. Specifically packing containers with multiple compartment mixing configurations.

2. Description of Prior Art

Prior art static mixing devices have been developed within the art to combine fluids by static mixing between multiple fluid-filled compartments. Such mixing packages as well known in the adhesive art where an independently non-reactive materials are combined as they are dispensed to form a reactive useful material, such as resin mixing dispensing devices for adhesives, fillers, and bonding agents. Such duel compartment devices can be seen in U.S. Pat. Nos. 4,657,534, 4,952,068, 5,263,609 and U.S. Publication 2005/0128866 and 2008/0123465.

In U.S. Pat. No. 4,657,534 a duel compartment disposable mixing and dispensing container is disclosed, having a main material compartment into which is inserted a plunger having a secondary fluid material to be mixed using hydraulic pressure imparted by the plunger.

U.S. Pat. No. 4,952,068 is directed towards a static mixing container having two independent material compartments which under external pressure release their contents into an interconnected mixing chamber from which the combined materials are dispensed.

U.S. Pat. No. 5,263,609 claims a dispensing container wherein the contents of which are dispensed when folded over and pressure is applied.

U.S. Publication 2005/012886 is for a medical package mixing device having a first containment space with a second fluid containment space within the first, so that by breaking the second containment space the contents of the two will be mixed and then can be dispensed.

Finally in U.S. Publication 2008/0123465, a device is directed to a multi-compartment foil type container having a formed first and second container with a discharge duct and deflection elements within the discharge duct and manual hinged container receiver to dispense material therefrom.

SUMMARY OF THE INVENTION

A disposable single use blister package having two heat-sealed fluid-filled compartments positioned for compression of one compartment and the contents released into the adjacent compartment, achieving mixing therewithin before being dispensed therefrom. A method of manufacturing the blister package configuration involves sealing of compartments defining a frangible pressure oriented seal there between which maintains separation of the compartments' contents until external force is applied to one compartment rupturing the frangible seal there between and mixing the content within the second compartment to be dispensed.

DESCRIPTION OF THE PREFERRED EMBODIMENT

Referring to FIGS. 1-4 of the drawings, a dual chambered frangible blister mixing and dispensing package 10 of the invention can be seen having a pair of blister-formed cavities 11,12 with an overlying closure layer 13 sealed thereon. The blister-formed cavities 11, 12 for separate liquid retention and separation are first formed with a roll of synthetic resin based material 14 by conventional blister packaging methods. The blank base material 14 is preheated to a pliable yieldable temperature determined by selection of resin material and thickness to be used. In this example chosen for illustration, the material is noted as 60 gram PVDC/2 mil PE.

Figure 4:
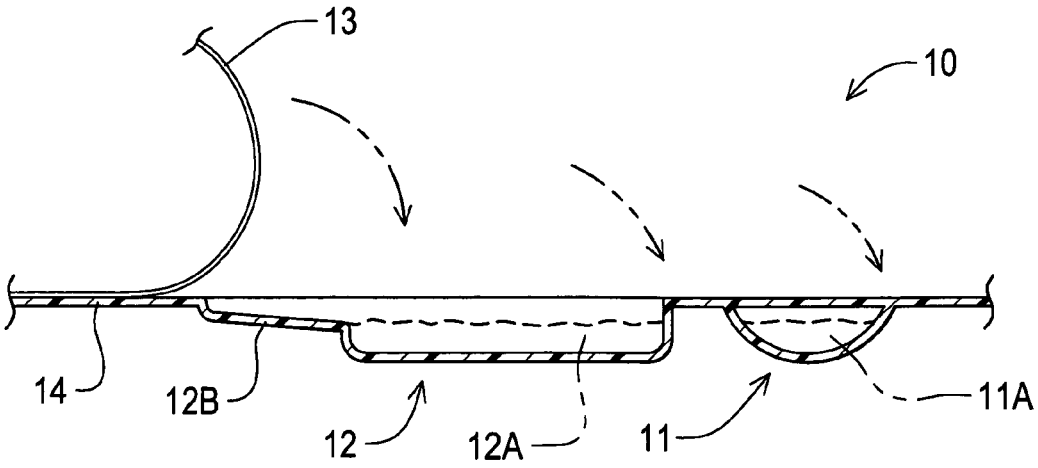
FIG. 4 is an enlarged graphic sectional illustration showing filling and sealing of multiple chambers.

The unrolled blank of base material 14 is deformed by a "plug" assist formation method to create a half spherical shaped cavity 11 and the elongated contoured rectangular shaped cavity 12 with a dispensing "spout" channel 12B extending in a communication therewith as best seen in FIG. 4 of the drawings which processes typical and well-known within the blister packaging forming art.

The closure layer 13, also of synthetic resin material, may be of a thinner dimensional thickness than the base 14. In this example, chosen for illustration, the material noted is PET/white PE/aluminum/heat seal film which is positioned over the here and before described first and second liquid receiving cavities 11, 12 after they are filled independently with dissimilar fluids, indicated graphically at 11A, 12A to be mixed prior to dispensing as seen in FIG. 4 of the drawings.

The sealing process takes place after the cavities, as noted, are filled in which such sealing process defines the novelty of the invention as described hereinafter.

Once the closure (lidding) material 13 is advanced over the pre-filled cavities 11 and 12, a sealing operation is employed that will impart a primary overall sealing 15 and a frangible seal 16 between the respective cavities 11 and 12.

Figure 5:
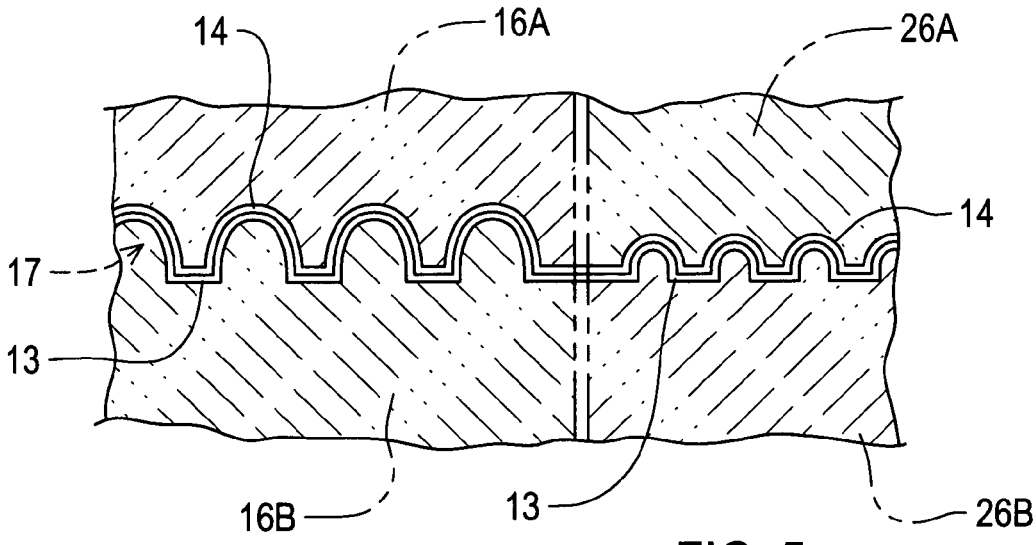
FIG. 5 is an enlarged partial cross-sectional view illustrating knurled surface seal formation and frangible seal configuration.

The primary sealing 15 is achieved by a pair of primary cavity sealing die portions 16A and 16B with opposing induced knurled pattern 17, best seen in FIG. 5 of the drawings by applying heat, pressure and dwell time, sufficient to deform and seal upon engagement against the closure material 13 and the base material 14 bonding same together, defining a liquid tight seal around the majority of the respectively defined perimeter of the cavity defined areas 11 and 12 forming separate liquid filled containment chambers 20, 21. This process assures a seal that initially restricts the contents of the liquid filled containment chambers 20, 21 from coming in contact and being retained therein.

Figure 1:
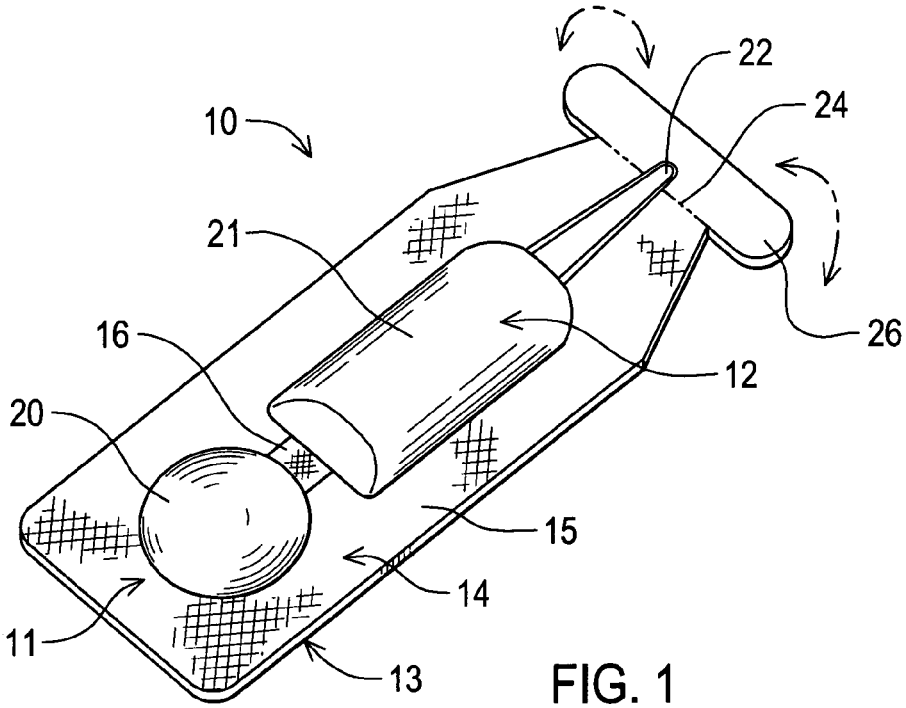
FIG. 1 is a perspective view of the blister mixing package of the invention.
Figure 2:
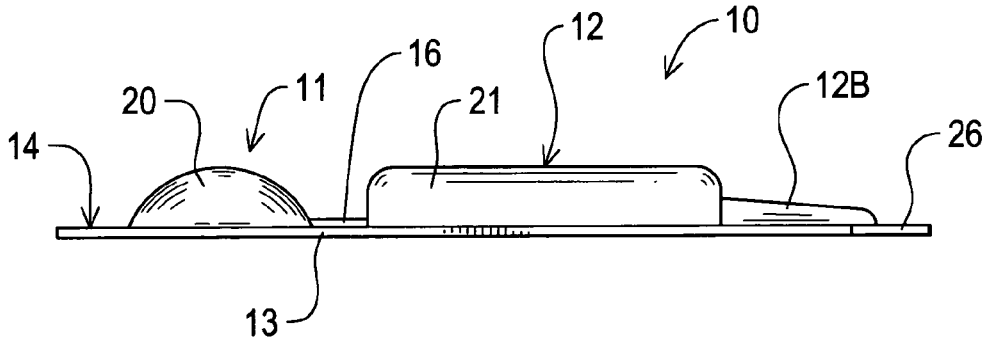
FIG. 2 is a front elevation view thereof.
Figure 3:
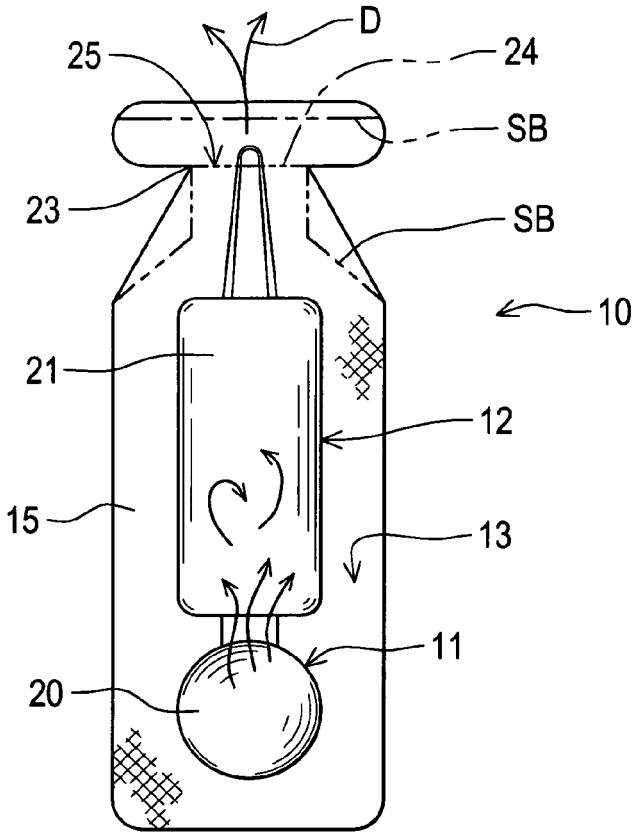
FIG. 3 is a top plan view thereof showing graphic fluid transfer during use and dispensing.

The liquid tight seal around the defined chambers 20,21 includes and forms the dispensing spout 14 which is tapered along both its longitudinal and transverse axis to a terminal dispensing tip at 22 as seen in FIG. 3 of the drawings. The base material 14 has oppositely disposed dispensing access notches 23 therein and is perforated inwardly respectively therefrom at 24 so as to define a weakened break line 25 and a tab portion 26 which correspondingly intersects the dispensing tip 22 which allows same to be opened for the dispensing of the contents of the chamber 21 through the here and before defined spout 14.

Figure 6:
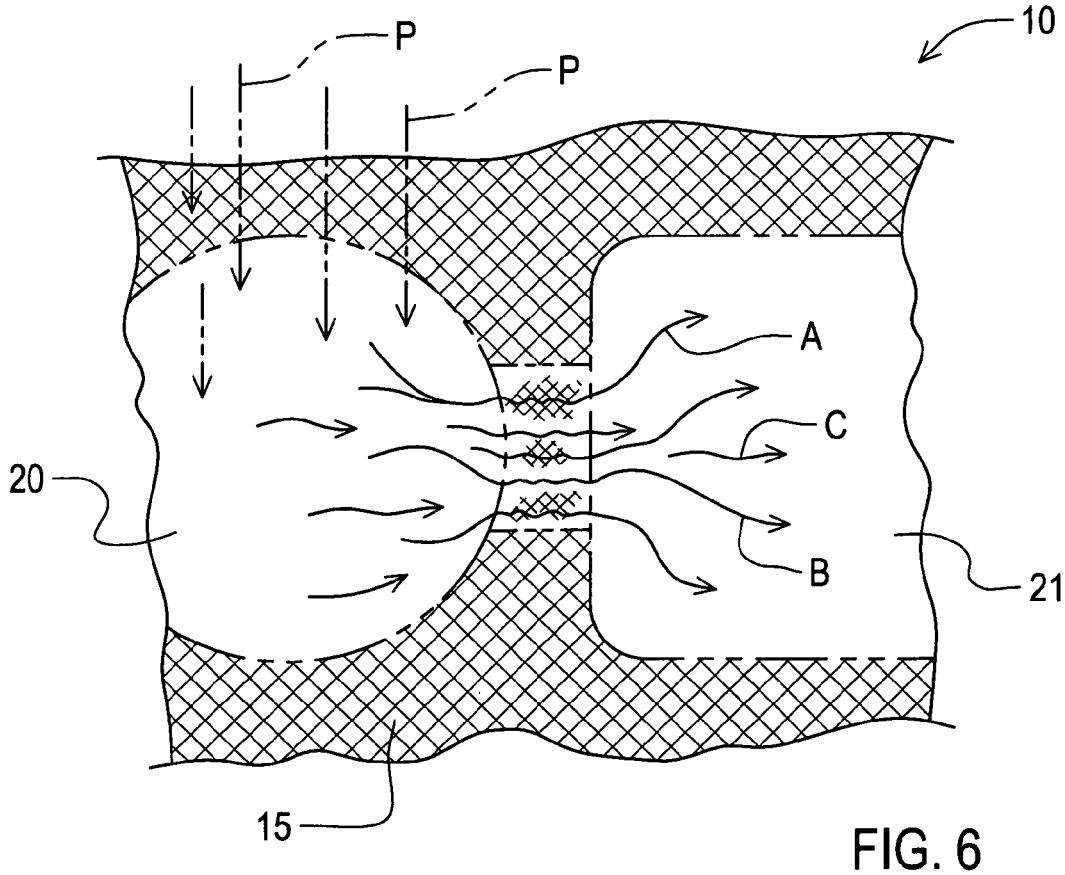
FIG. 6 is a partial enlarged top plan graphic fluid force flow diagram illustrating frangible seal separation under pressure and transfer of contents between compartments.

The frangible seal 16 is formed between the here and before defined chambers 20 and 21 by sealing die portions 26A and 26B having an inter-engaging knurl induced pattern of reduced relief face dimension by applying pressure, heat and dwell time forming the true independent frangible seal 16 of the invention there between as seen graphically in FIGS. 3 and 6 of the drawings.

The blister package formed with frangible seal 16 maintains a separation seal initially between the filled chambers 20 and 21, but under outside applied pressure (by user not shown) indicated by pressure vector arrows (P) in this example on the spherical cavity chamber 20 force the frangible seal 16 to separate due to its reduced material sealing surfaces allowing the contents chamber 20 to be forced under applied pressure into the now inter-connecting adjacent chamber 21 imparting a fluid mixing there between as shown graphically in FIGS. 3 and 6 of the drawings by mixing arrows A, B and C. Once the static-induced combining and mixing of the chambers' contents, the dispensing "spout" 12B is breached by the here and before described breakaway tab portion 26 which given the rigidity of the base, in this example, requires trans-lateral flexing allowing the combined mixed contents of chamber 21 to be dispensed therefrom indicated by directional broken arrow D in FIG. 3 of the drawings.

As noted the respective two sealing surfaces formation process requires the die portions 16A, 16B, and 26A and 26B, to be precisely controlled and regulated for time and pressure. Digitally controlled for heat to maintain the heat applied to the blister, for a relatively constant value for proper sealing in both the primary chambers/cavities sealing and the critical frangible seal 16 so there between.

It will be evident by utilization of different dimensional base and closure material. A "flexible soft blister" configuration can be achieved by the same sealing formation process hereinbefore described. Such "soft blister" formations are identical to that described in the preferred embodiment except is for the spout dispensing access, which given the flexible soft nature of materials used, allows for simple manual transverse cutting on tearing by the user (not shown) at a defined notch and cut portions CP which are illustrated in FIG. 3 of the drawings in broken lines for the soft blister SB application.

It will thus be seen that by utilization of the multiple surfaces die configuration sealing process that a dual chamber frangible blister package 10 of the invention can be achieved and which provides a unique and novel disposable one-use static mixing package for multiple use applications in a variety of pharmaceutical and other venue-driven applications.

It will be apparent to those skilled in the art that various changes and modifications may be made therein without departing from the spirit of the invention.

Therefore we claim:

1. A method of making a frangible blister mixing and dispensing package which comprises, a. a base of synthetic resin material, b. forming at least two liquid retaining cavities and a dispensing spout in communication with one of said cavities within said base, c. filling said respective cavities with independent liquids to be mixed, d. positioning a thin flexible closure sheet over said cavities and dispensing spout and remaining base surface material thereabout, e. applying heat, pressure and dwell time to said overlying closure sheet and base material by respective opposing die surfaces having first and second opposing textured faces sealing said closure sheet to said base, forming a first liquid filled chamber and a second liquid filled chamber with a dispensing spout, f. applying heat, pressure and dwell time to a portion of said closure sheet and said base between said first and second liquid filled form chambers by said second opposing textured face die surfaces of reduced relief dimension, defining a frangible communication path there between, g. weakening portions of said sealed closure and base adjacent an end dispensing tip portion of said dispensing spout h. sealing said first and second textured faces opposing the surface of differing relief dimension in an aligned cross hatch sealing pattern between said closer material and said cavity forming base material.

2. The methods set forth in claim 1 wherein the forming of at least two liquid retaining chambers and a dispensing spout is by plug assist molding technique.

3. The method set forth in claim 1 wherein the applied heat, pressure and dwell time of said respective first and second opposing textured face die surfaces is digitally controlled.

4. The method set forth in claim 1 in wherein were in said first opposing textured face dies seals said closure sheet to said base around the perimeter of said respective chambers defining a passageway there between.

5. The method set forth in claim 1 wherein said cavities forming base of synthetic resin material is of a dimensional rigidity greater than that of said flexible closure sheet.

6. The method set forth in claim 1 wherein weakening portions of said sealing and closure base comprises, oppositely disposed perimeter edge transversely aligned notches therein defining a break-away tab portion.

7. The method set forth in claim 1 wherein weakening portions of said sealed closure and base adjacent an end dispensing tip portion of said dispensing spout further comprises, aligned perforations.

8. The method set forth in claim 1 wherein applied external pressure on said first liquid filled chamber ruptures said frangible communication path between said first and second liquid filled chambers forcing fluid transfer and mixing in said second fluid filled chamber with said dispensing spout.

* * * * *